US008353726B2

(12) United States Patent
Zhang et al.

(10) Patent No.: US 8,353,726 B2
(45) Date of Patent: Jan. 15, 2013

(54) ELECTRICAL CONNECTOR WITH GROUNDING BARS THEREIN TO REDUCE CROSS TALKING

(75) Inventors: George Huanyi Zhang, Irvine, CA (US); Gustavo F. Duenas, Placentia, CA (US)

(73) Assignee: Hon Hai Precision Inc. Co., Ltd., New Taipei (TW)

( * ) Notice: Subject to any disclaimer, the term of this patent is extended or adjusted under 35 U.S.C. 154(b) by 149 days.

(21) Appl. No.: 12/939,156

(22) Filed: Nov. 3, 2010

(65) Prior Publication Data

US 2012/0108109 A1 May 3, 2012

(51) Int. Cl.
*H01R 24/00* (2006.01)

(52) U.S. Cl. ..... 439/629; 439/637

(58) Field of Classification Search ..... 439/629, 439/637, 660, 79
See application file for complete search history.

(56) References Cited

U.S. PATENT DOCUMENTS

| | | | | |
|---|---|---|---|---|
| 6,832,934 | B1 * | 12/2004 | Zhang | 439/660 |
| 6,942,524 | B2 | 9/2005 | Wu | |
| 7,744,427 | B2 * | 6/2010 | Zhang et al. | 439/660 |
| 7,878,816 | B2 * | 2/2011 | Zhu | 439/65 |
| 7,909,652 | B2 * | 3/2011 | Yang et al. | 439/660 |
| 7,914,302 | B1 * | 3/2011 | Zhu | 439/79 |
| 2009/0221165 | A1 | 9/2009 | Buck et al. | |
| 2011/0269346 | A1 | 11/2011 | Casher et al. | |

* cited by examiner

*Primary Examiner* — Hae Moon Hyeon
(74) *Attorney, Agent, or Firm* — Wei Te Chung; Ming Chieh Chang

(57) ABSTRACT

An electrical connector includes an insulated housing defining an uninterrupted tongue portion with opposite first surface and second surface, the first surface defining a rib and a plurality of contacts loaded in the tongue portion. The contacts include first contacts with contacting sections loaded in the first surface at one side of the rib, second contacts with contacting section loaded in the first surface at another side of the rib and third contacts with contacting section loading in the second surface opposite to the rib. Each of the first and third contacts is composed of signal contacts and grounding contacts. Two distinct grounding bars are embedded in the tongue section and touch with front ends of grounding contacts of the first and third contacts respectively to reduce cross talk between signal contact of the first and third contacts.

19 Claims, 6 Drawing Sheets

ELECTRICAL CONNECTOR WITH GROUNDING BARS THEREIN TO REDUCE CROSS TALKING

BACKGROUND OF THE INVENTION

1. Field of the Invention

The present invention generally relates to an electrical connector, and more particularly to an electrical connector capable of high speed and backwards compatibility with relative lower high speed.

2. Description of Related Art

Serial Attached SCSI (SAS) is a successor to the parallel SCSI and is also based on serial technology. Besides the advantage of higher speed signal transmission, another most significant advantage is that the SAS interface will also be compatible with SATA drives. In other words, the SATA plug connector can plug directly into a SAS receptacle connector if supported in the system. By this way, the system builders are flexible to integrate either SAS or SATA devices and slash the costs associated with supporting two separate interfaces.

U.S. Pat. No. 6,942,524 discloses a SAS connector for SAS 2.0 standard transmitting 6.0 Gbps. Higher signal transmission is a tendency in high speed industry. Connectors adapted for speed higher than 6.0 Gbps is developing. Questions of electrical performance, such as cross talk, signal attenuation arises. Particularly, crosstalk is a major issue at 12 Gbps. So, we hope design an electrical connector to overcome said question.

SUMMARY OF THE INVENTION

Accordingly, an object of the present invention is to provide electrical connectors capable to 12 Gbps.

In order to achieve the object set forth, an electrical connector comprises an insulated housing defining an uninterrupted tongue portion with opposite first surface and second surface, the first surface defining a rib and a plurality of contacts loaded in the tongue portion. The contacts comprise first contacts with contacting sections loaded in the first surface at one side of the rib, second contacts with contacting section loaded in the first surface at another side of the rib and third contacts with contacting section loading in the second surface opposite to the rib. Each of the first and third contacts is composed of signal contacts and grounding contacts. Two distinct grounding bars are embedded in the tongue section and touch with front ends of grounding contacts of the first and third contacts respectively to reduce cross talk between signal contact of the first and third contacts.

Other objects, advantages and novel features of the invention will become more apparent from the following detailed description when taken in conjunction with the accompanying drawings.

DETAILED DESCRIPTION OF THE INVENTION

Reference will now be made in detail to the preferred embodiment of the present invention.

Figure 1:
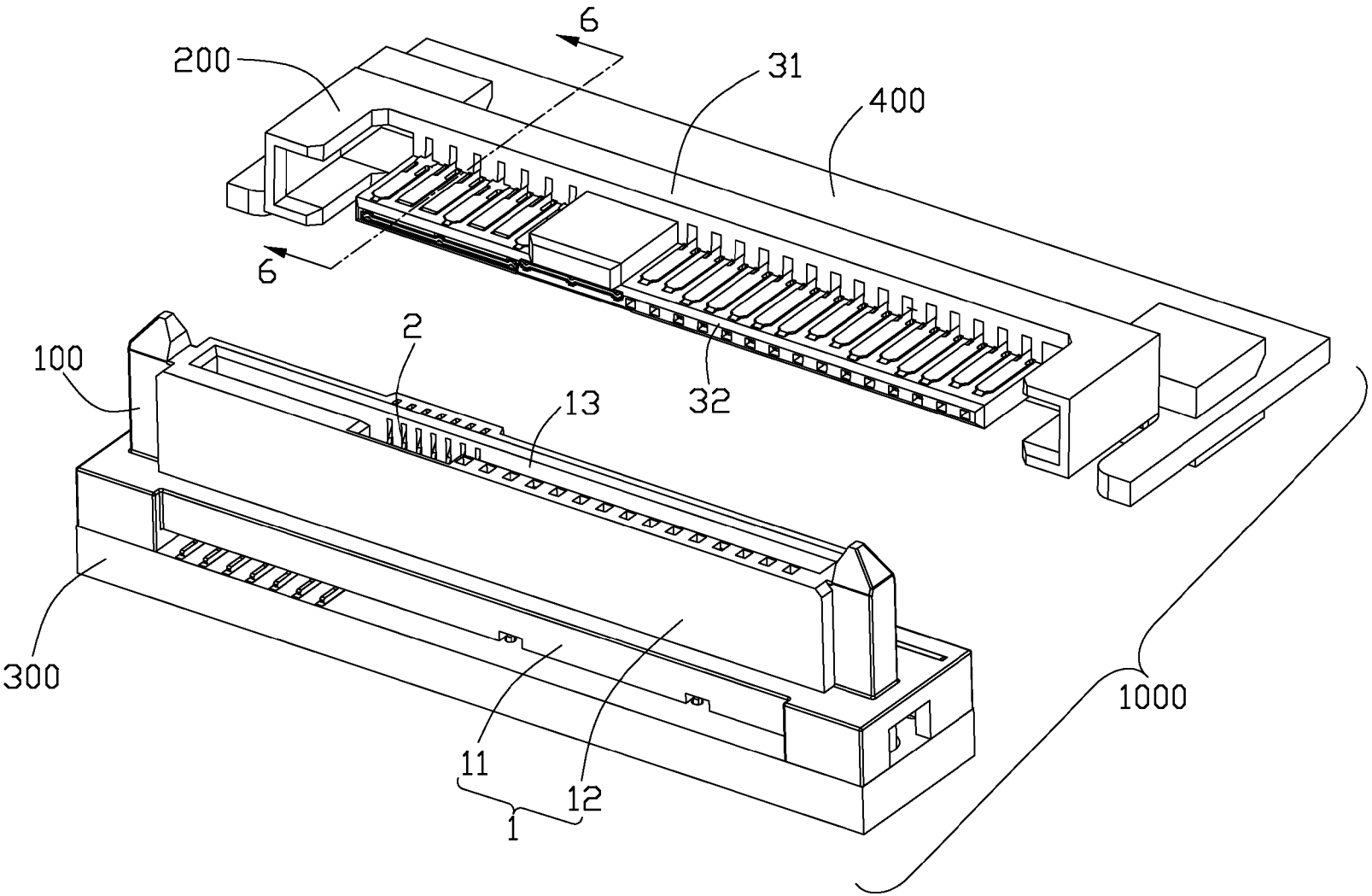
FIG. 1 is a perspective view of an electrical assembly in accordance with the present invention, the electrical assembly including a first electrical connector and a second mating electrical connector.

Referring to FIG. 1, an electrical connector assembly 1000 including a first electrical connector 100 vertically mounted on a first circuit board 300 and a second electrical connector 200 right-angle mounted on a second circuit board 400 is illustrated. The electrical connectors 100, 200 are used for providing interfaces for a high speed storage device, especially for SAS signal transmission which is capable to 12 Gbps operation.

Figure 2:
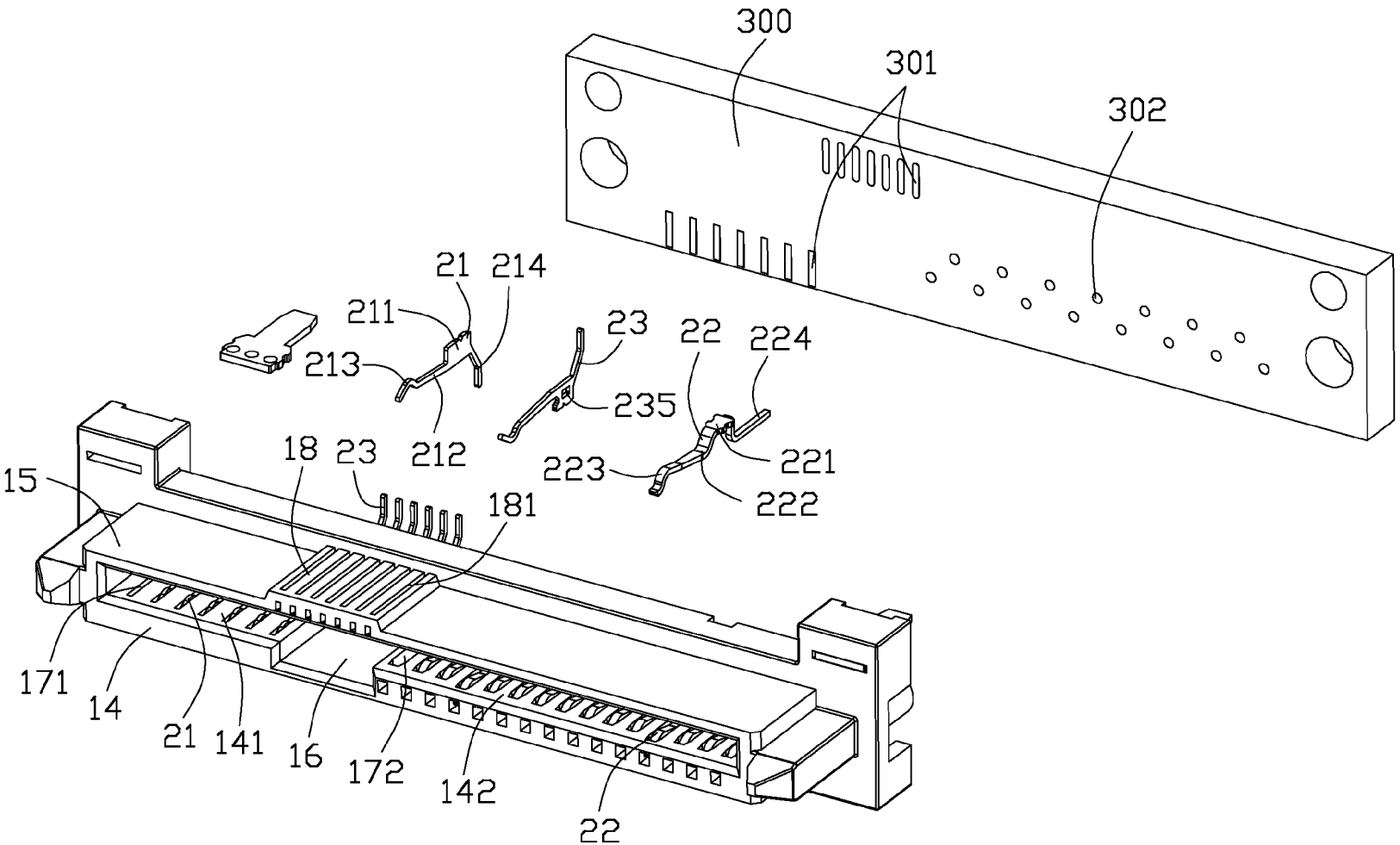
FIG. 2 is an exploded perspective view of the first electrical connector and a first PCB shown in FIG. 1.

Referring to FIGS. 1 and 2, the first electrical connector 100 includes an insulated housing 1 including a base portion 11 and a mating portion 12 projecting from a top face of the base portion, and a plurality of contacts 2 assembled to the insulated housing 1. The insulated housing 1 defines a longitudinal uninterrupted slot 13 extending in a first direction and a second direction through the front face and surrounded by two parallel first and second sidewalls 14, 15. The first sidewall 14 is divided at an inside surface thereof, to two separated parts by a groove 16 without any conductive contacts and extending through the front face in the second direction. The first part 141 is loaded with seven first conductive contacts 21 in corresponding passageways 171 not through the front face, which is functioned as a signal segment S1-S7 defined in SAS 2.0 Specification. The second part 142 is loaded with fifteen second conductive contacts 22 in the passageways 172 through the front face of the mating portion, which is functioned as a power segment P1-P15 defines in SAS 2.0 Specification.

The second sidewall 15 defines an expanding portion 18 heighten in a third direction perpendicular to the first and second directions. The expanding portion is aligned with the grooves 16. The expanding portion 18 is loaded with seven third conductive contacts 23 in the passageways 181 through the front face and through the second sidewall 15 in the third direction, which is functioned as a signal segment S8-S14 defines in SAS 2.0 Specification.

The contacts in every segment have a same configure. The first and the third conductive contacts 21, 23 have a same shape, arranged mirror to each other. So the same contacts are only introduced one time. The first conductive contact 21 of a vertical type by cutting a metal sheet and includes a board retaining portion 211 with barbs at a top edge thereof, an elastic arm 212 with an inward-converted contacting portion 213 at a freed end thereof and a tail portion 214 extending opposite to the projection direction of the contacting portion 213. The elastic portion 212 and the tail portion 214 extend from opposite lateral sides of the retaining portion 211. The third contact 23 further defines an open 235 in a centre thereof which not only adjusts matching impedance but also interlocks with housing for securing (not shown). The first and third conductive contacts 21, 23 are formed by cutting in the metal sheet, i.e., the contacting portion 213 is formed at a cutting face of the metal sheet and the barbs extend from the cutting face. The contacting portion 213 defines a mating or elastic enforce orientation which is parallel to the retaining portion 211.

The second conductive contacts 22 is of a horizontal type which is made by cutting and bending a metal sheet, which includes a retaining portion 221 with barbs at opposite lateral sides of the retaining portion, an elastic arm 222 with an inward-converted contacting portion 223 at a freed end thereof and the tail portion 224. The elastic arm 222 and the tail portion 224 extend from opposite ends of the retaining portion 221. The contacting portions 223 also define a mating orientation parallel to the mating orientation of the first and the third contacts. Since the contacts 2 are mated with the second connector 200 through the slot 13, the mating orientation of all contacts is common defined along the same mating orientation. The retaining portions 221 of the second conductive contacts 22 are perpendicular to the mating orientation and the contacting portions 223 are formed in metal sheet plane, not the cutting face. The tail portions of the fist and the third conductive contacts are soldered to conductive pads 301 of the PCB by SMT while the tail portions of the second conductive contacts are by through holes 302.

Figure 3:
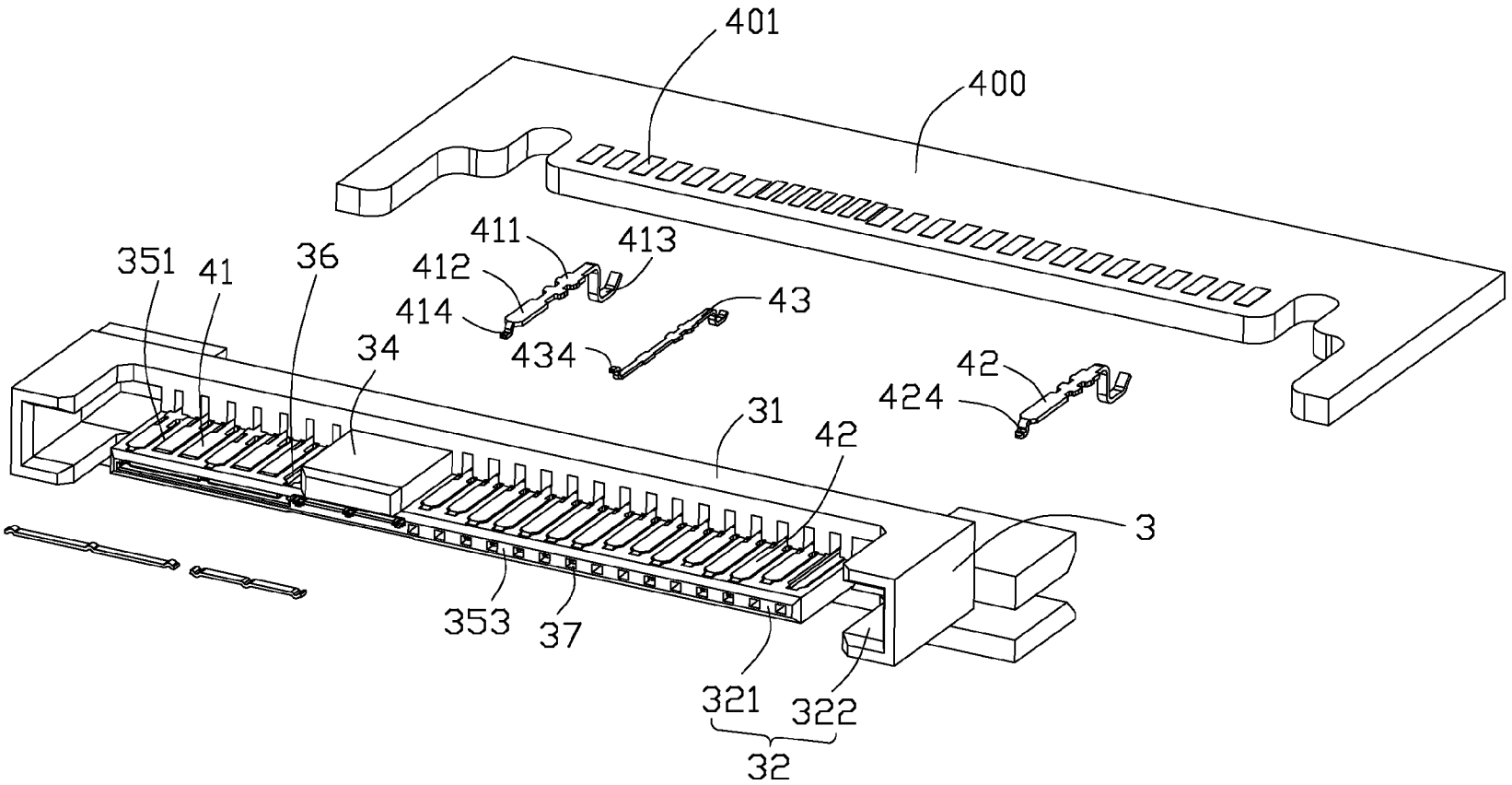
FIG. 3 is an exploded perspective view of the second electrical connector and a second PCB shown in FIG. 1.
Figure 4:
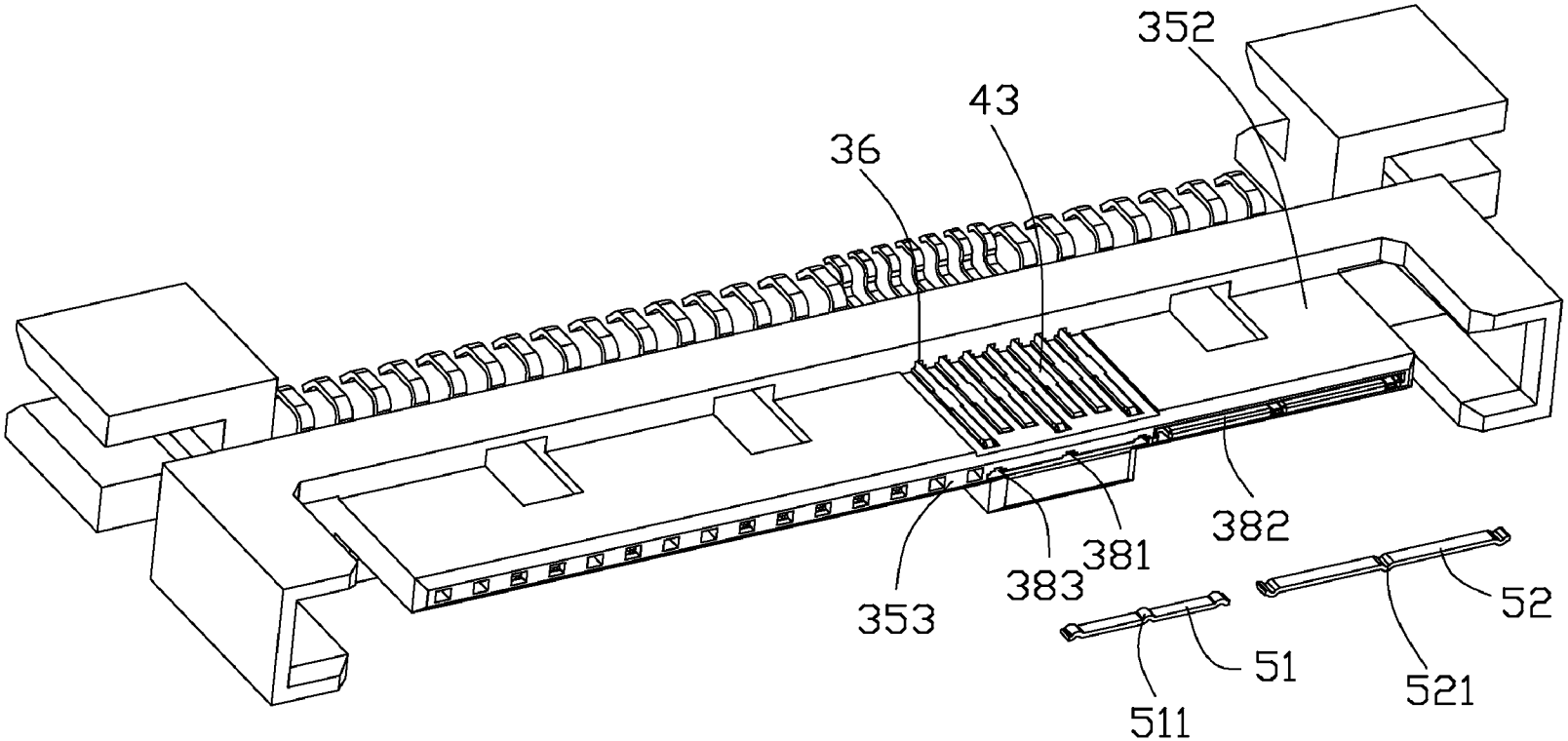
FIG. 4 is an exploded perspective view of the second electrical connector from another view.

Referring to FIGS. 3 and 4, the second electrical connector 200 intended to mate with the first electrical connector 100, include an insulative housing 3 comprising a base portion 31 and a mating portion 32 which is formed by an uninterrupted tongue portion 321 and a pair of guiding portions 322 of an inverted U shape commonly extending from the base portion 31. The tongue portion 321 defines a rib 34 at a first surface 351 thereof unitarily extending forwards from the base portion 31 to a front face 353, the rib 34 divides the first surface 351 to two sections, one being larger than the other section. The rib 34 and said two sections incorporate with the groove 16 and the two parts of the first electrical connector 100. The contacts 41, 42, 43 loaded in the first and second surface of the tongue portions 321 are defined same to arrangement and designation of the contacts 21, 22, 23 of the first electrical connector 100, so description of the functions of the contacts of the second connector 200 is omitted.

Seven pieces of first contacts 41 located in left section of the first surface 351 are intend to mate with the first contacts of the first electrical connector 100, which is named as signal segment, while power pieces of second contacts 42 located in the right section of the first surface 351 intend to mate with the second contacts of the first electrical connector, which is named as a power segment. Seven pieces of third contacts 43 loaded in the second surface 352 of the tongue portion. Said contacts of three rows are of plane shape, each substantially includes a plate section retained in the insulating housing and a leg section 413 perpendicularly bending from the plate section and then bending rearward to press against conductive pads 401 on the second PCB. The plate section include a retaining portion 411 with barb at lateral sides thereof and a contacting portion 412 extending from the retaining portion 411 which is received in the passageways 36 defined on the first and second surface of the tongue portion 321 and expose to an exterior in a direction perpendicular to the surfaces of the tongue portion 321. Please notes, the first and second contacts 41, 42 are wider than the third contacts 43. Each of all of the second contacts 42 further includes a bending tip 424 (i.e. a extension or extending forwards and downwards) at the front distal end of the contacting portion which slants toward the second surface 352 and forward so as to receive in an open 37 defined at the front face 353 of the tongue portion 321. Each of three of the seven first contacts 41 also defines a bending tip 414 (i.e. a extension) at the front distal end of the contacting portion 412 which slants toward the second surface 352 and forward. Three of the seven third contacts 43 also each define a bending tip 434 (i.e. a extension) similar to said bending tip 414 of the first contacts 41. Please note, either of the first and the second contacts is arranged in a pattern with G-S(+)-S(−)-G-S(+)-S(−)-G-S(+)-S(−). So two adjacent contacts S(+)-S(−) are configured as one differential pair, said three contacts are of grounding contacts and alter with a plurality of differential pairs.

Figure 5:
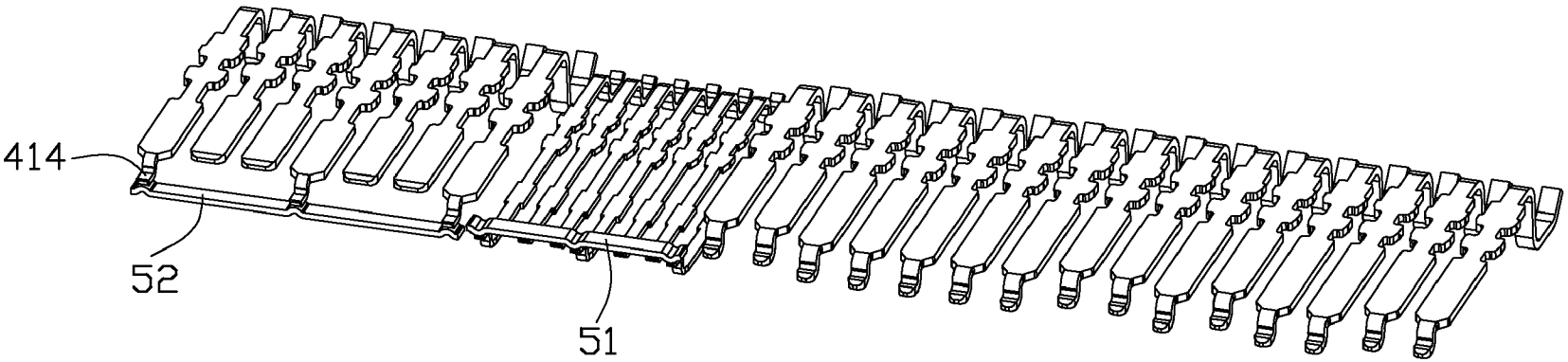
FIG. 5 is a perspective view of contacts and grounding bars of the second electrical connector.
Figure 6:
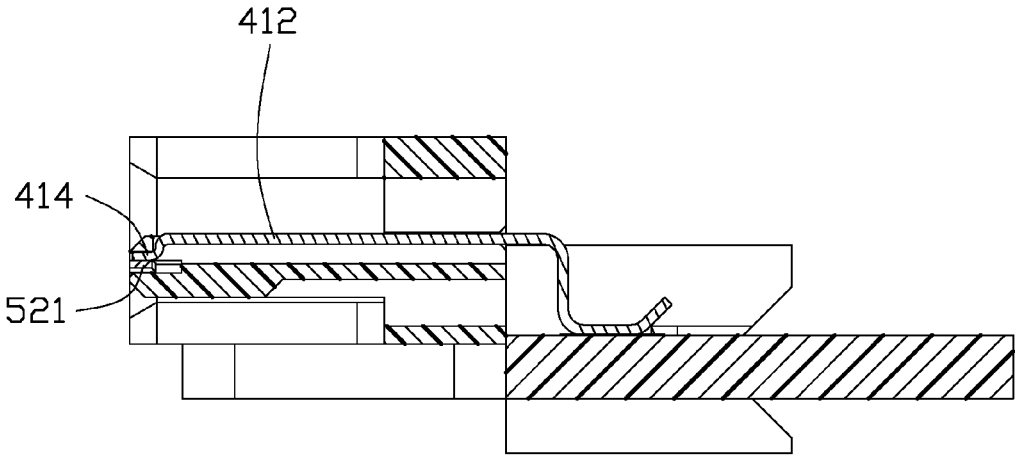
FIG. 6 is a cross section view of the second electrical connector taken along lines 6-6 in FIG. 1.

Combination with FIG. 4, the tongue portion defines two slots 381, 382 recessed rearwards from the front face 353 thereof aligned with said two signal segments. The first slot 381 further comprises three notches 383 at one side thereof near to the second surface 352 and the three notches are aligned with and communication with corresponding passageways 36 which are used to receive the grounding contacts. A first metal grounding bar 51 is received in the first slot 381, which has three arc convexes or projections 511 projecting in the notches 383 so the bending tips 434 mechanically touch the arc convexes 511 as best shown in FIGS. 5 and 6. A second metal grounding bar 52 is received and retained in the second slot 382, arc convexes 521 of the second grounding bar bend to the first surface 351 where the first and second contacts are loaded. The arc convexes 511 projection towards the second surface 521 while the arc convexes 521 project towards the first surface 511, i.e. the convexes 511, 521 of said two grounding bars project in opposite direction. The ground bars are barred in the tongue portion 321 and do not effect mating and un-mating function. The ground bars between ground contacts of the two signal segments add short pass between signal return pass which will reduces the crosstalk. Therefore, the electrical connector assembly 1000 can be used to transport high speed up to 12 Gbps. Moreover, the first and second electrical connector is same to the designation of the connectors in SAS 2.0 Specification in dimension and pin arrangement which has a high speed capable to 6 Gbps except the addition of the grounding bars. Using a same interface, the connectors of this present invention speed signal transmission up to 12 Gbps.

It is to be understood, however, that even though numerous characteristics and advantages of the present invention have been set forth in the foregoing description, together with details of the structure and function of the invention, the disclosure is illustrated only, and changes may be made in detail, especially in matters of shape, size, and arrangement of parts within the principles of the invention to the full extent indicated by the broad general meaning of the terms in which the appended claims are expressed.

We claim:

1. An electrical connector comprising:

an insulated housing defining an uninterrupted tongue portion with opposite first surface and second surface, the first surface defining a rib;

a plurality of contacts loaded in the tongue portion and comprising first contacts with contacting sections loaded in the first surface at one side of the rib, second contacts with contacting section loaded in the first surface at another side of the rib and third contacts with contacting section loaded in the second surface opposite to the rib;

each of the first and third contacts is composed of signal contacts and grounding contacts; and two distinct grounding bars embedded in the tongue section and constantly touching with front ends of grounding contacts of the first and third contacts respectively to reduce cross talk between signal contact of the first and third contacts.

2. The electrical connector as claimed in claim 1, wherein the tongue portion defines two slots to receive the grounding bars, each grounding bar defines arc convexes projecting in notches defined at one side of the slots adjacent to the corresponding contacts with which the grounding bar touch.

3. The electrical connector as claimed in claim 2, wherein the convexes of said two grounding bars project in opposite direction directions.

4. The electrical connector as claimed in claim 3, wherein the grounding contacts of first and third contacts each have a bending tip at a distal free end of the contacts sections thereof to touch with the convexes of the corresponding grounding bars.

5. An electrical connector comprising:

an insulative housing defining an elongated base along a lengthwise direction with a mating tongue extending, from the base, transversely in said lengthwise direction and forwardly along a front-to-back direction perpendicular to said lengthwise direction;

a set of contacts disposed in the housing and including a plurality of differential pairs and a plurality of grounding contacts alternately arranged each other in said lengthwise direction, each of said contacts including a front contacting section exposed upon one face of the mating tongue and a rear mounting section for mounting to a printed circuit board; and a conductive grounding bar located at a tip of the mating tongue and extending in said lengthwise direction while spaced from front tips of the contacting sections; wherein compared with the differential pairs, each of the contacting sections of the grounding contacts further includes an extension constantly mechanically and electrically connected to corresponding arc convexes defined on the grounding bar.

6. The electrical connector as claimed in claim 5, wherein the contacting sections are exposed upon the face for connecting with corresponding terminals of a complementary mated connector in a vertical direction perpendicular to both said lengthwise direction and said front-to-back direction, and said grounding bar contacts the extension of the corresponding grounding contacts in the same vertical direction.

7. The electrical connector as claimed in claim 6, wherein said grounding bar is essentially located around a horizontal center line of a front ridge face of said mating tongue.

8. The electrical connector as claimed in claim 5, wherein an expansion is formed on an opposite face of the mating tongue opposite to the contacting sections of said contacts.

9. The electrical connector as claimed in claim 8, wherein said grounding bar is located essentially intimately at a boundary line between said arc convexes and said mating tongue in the vertical direction.

10. The electrical connector as claimed in claim 8, further including another set of contacts disposed in the housing with contacting sections exposed upon said opposite face and including differential pairs and grounding contacts alternately arranged with each other in said lengthwise direction under condition that said another set of contacts neighbors said set of contacts in the lengthwise direction, and another conductive grounding bar located at the tip of the mating tongue and extending along the lengthwise direction and mechanically and electrically connecting to the contacting sections of corresponding grounding contacts; wherein the grounding bar contacts the contacting sections of the set of contacts in a first vertical direction perpendicular to both said lengthwise direction and said front-to-back direction, while said another grounding bar contacts the contacting sections of said another set of contacts in a second vertical direction opposite to said first vertical direction.

11. The electrical connector as claimed in claim 5, wherein said extension extends forwardly along an axis of the front-to-back direction.

12. The electrical connector as claimed in claim 11, wherein said extension further extends in a vertical direction perpendicular to both said lengthwise direction and said front-to-back direction, from the face in a level toward another level, in said vertical direction, where said grounding bar is located.

13. An electrical connector comprising:

an insulative housing defining an elongated base along a lengthwise direction with a tongue portion extending, from the base, transversely in said lengthwise direction and forwardly along a front-to-back direction perpendicular to said lengthwise direction, said tongue portion defining opposite first and second faces thereon;

a set of first contacts disposed in the housing and including a plurality of first differential pairs and a plurality of first grounding contacts alternately arranged each other in said lengthwise direction, each of said first contacts including a front contacting section exposed upon the first face of the tongue portion in a stiff manner and a rear mounting section for mounting to a printed circuit board;

a discrete first conductive grounding bar located at a tip region of the tongue portion and extending in said lengthwise direction while spaced from front tips of the contacting sections; and a plurality of projections formed on the first grounding bar and projecting toward and contacting the front tips of the corresponding contacting sections, respectively, wherein the tip region of the tongue portion defines a first slot located between the opposite first and second faces in a vertical direction perpendicular to both said lengthwise direction and the front-to-back direction, and extending along said lengthwise direction and equipped with a plurality of notches aside under condition that the first slot receives the first grounding bar, and each of the projections projects into the corresponding notch where the front tip of the contacting section of the corresponding first grounding contact is located.

14. The electrical connector as claimed in claim 13, wherein the first slot is closer to the second face than to the first face in the vertical direction.

15. The electrical connector as claimed in claim 13, further including a set of second contacts disposed in the housing with contacting sections exposed upon said second face of the mating plate in a stiff manner and including second differential pairs and second grounding contacts alternately arranged with each other in said lengthwise direction under condition that said set of second contacts neighbors said set of first contacts in the lengthwise direction, and a discrete second conductive grounding bar is located at the tip region of the tongue portion and extending along the lengthwise direction and mechanically and electrically connecting to the contacting sections of corresponding second grounding contacts.

16. The electrical connector as claimed in claim 15, wherein the first grounding bar contacts the contacting sections of the first grounding contacts in the vertical direction, and said the second grounding bar contacts the contacting sections of said second grounding contacts in the vertical direction.

17. The electrical connector as claimed in claim 15, wherein said first grounding bar and said second grounding bar are arranged offset from each other in said vertical direction for preventing jeopardizing strength of the tongue portion around the tip region.

18. The electrical connector as claimed in claim 17, wherein a rib is formed on the second face opposite to said set of first contacts and said first grounding bar is essentially located between said rib and said set of first contacts in the vertical direction.

19. The electrical connector as claimed in claim 15, wherein said tip region of the tongue portion further defines a second slot located between the opposite first and second faces in the vertical direction and extending along the lengthwise direction to receive the second grounding bar, wherein the first slot is closer to the second face than to the first face while the second slot is closer to the first face than to the second face so as to offset the first grounding bar and the second grounding bar from each other in the vertical direction for avoiding weakening strength of the tip region of the tongue portion.

* * * * *